US007479930B2

(12) United States Patent
Young

(10) Patent No.: US 7,479,930 B2
(45) Date of Patent: Jan. 20, 2009

(54) ANTENNA ARRAY METHOD AND APPARATUS

(75) Inventor: Lawrence G. Young, Eagle Creek, OR (US)

(73) Assignee: Motorola, Inc., Schaumburg, IL (US)

( * ) Notice: Subject to any disclaimer, the term of this patent is extended or adjusted under 35 U.S.C. 154(b) by 264 days.

(21) Appl. No.: 11/231,178

(22) Filed: Sep. 20, 2005

(65) Prior Publication Data

US 2007/0063917 A1 Mar. 22, 2007

(51) Int. Cl.
*H01Q 21/00* (2006.01)
*H01Q 1/48* (2006.01)

(52) U.S. Cl. ..... 343/844; 343/846; 343/893

(58) Field of Classification Search ..... 343/833, 343/844, 846, 848, 874, 893
See application file for complete search history.

(56) References Cited

U.S. PATENT DOCUMENTS 2,630,530 A * 3/1953 Adcock et al. ..... 343/848
5,479,176 A * 12/1995 Zavrel, Jr. ..... 342/374
6,515,635 B2 * 2/2003 Chiang et al. ..... 343/834
7,030,831 B2 * 4/2006 Nilsson ..... 343/840

* cited by examiner

*Primary Examiner*—Shih-Chao Chen
(74) *Attorney, Agent, or Firm*—Valerie M. Davis

(57) ABSTRACT

A ground plane apparatus (200 ) has a plurality of substantially planar ground plane surfaces (201 ) that are connected, arranged, and configured to substantially form a pyramid-shaped object. A plurality of radiating antennas (202 ) are then provided with at least one such antenna being mounted on each of the plurality of substantially planar ground plan surfaces such that a line of sight (205 ) between tips of adjacent radiating antennas is substantially occluded by at least one of the substantially planar ground plan surfaces. An electrically conductive raised surface (401 ) may be mounted along adjacent edges of the substantially planar ground plane surfaces. Such raised surfaces may further aid in more fully occluding the line of sight between adjacent radiating antennas. As another optional approach, additional shorted antennas (501 ) are also mounted along at least some of the above-noted adjacent edges to further aid in occluding this line of sight.

19 Claims, 2 Drawing Sheets

ANTENNA ARRAY METHOD AND APPARATUS

FIELD OF THE INVENTION

This invention relates generally to antenna structures and more particularly to antenna arrays.

BACKGROUND OF THE INVENTION

Antennas and antenna arrays are well known in the art. Conflicts often arise between desired control capabilities or orientation and corresponding desired performance. For example, one typical design approach provides one antenna for each control station. Such antennas are typically installed on a roof or tower. This approach produces minimal insertion loss and tends to maximize coverage for talkaround requirements. On the other hand, this approach also tends to require maximum roof/tower space usage in order to meet mutual interference and antenna pattern requirements (presuming, of course, that adequate installation space exists and that such an approach otherwise accords with local visual aesthetic needs, guidelines, or requirements).

As another example, and particularly when seeking to avoid the above-noted antenna space requirements, hybrid control station combiners are often used to reduce antenna counts. For example, instead of requiring eight separate antennas to support eight control station radios, a combiner may be used to reduce the antenna count to, for example, two antennas. Undesirable trade-offs here include the significant cost of the combiner technology and 11 dB (or more) of combiner insertion loss. These concerns often, in turn, drive usage of highly directional gain antennas to attempt to recoup the losses. Such highly directional gain antennas typically present their own set of corresponding trade-offs and points of complication.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

DETAILED DESCRIPTION OF THE INVENTION

Figure 1:
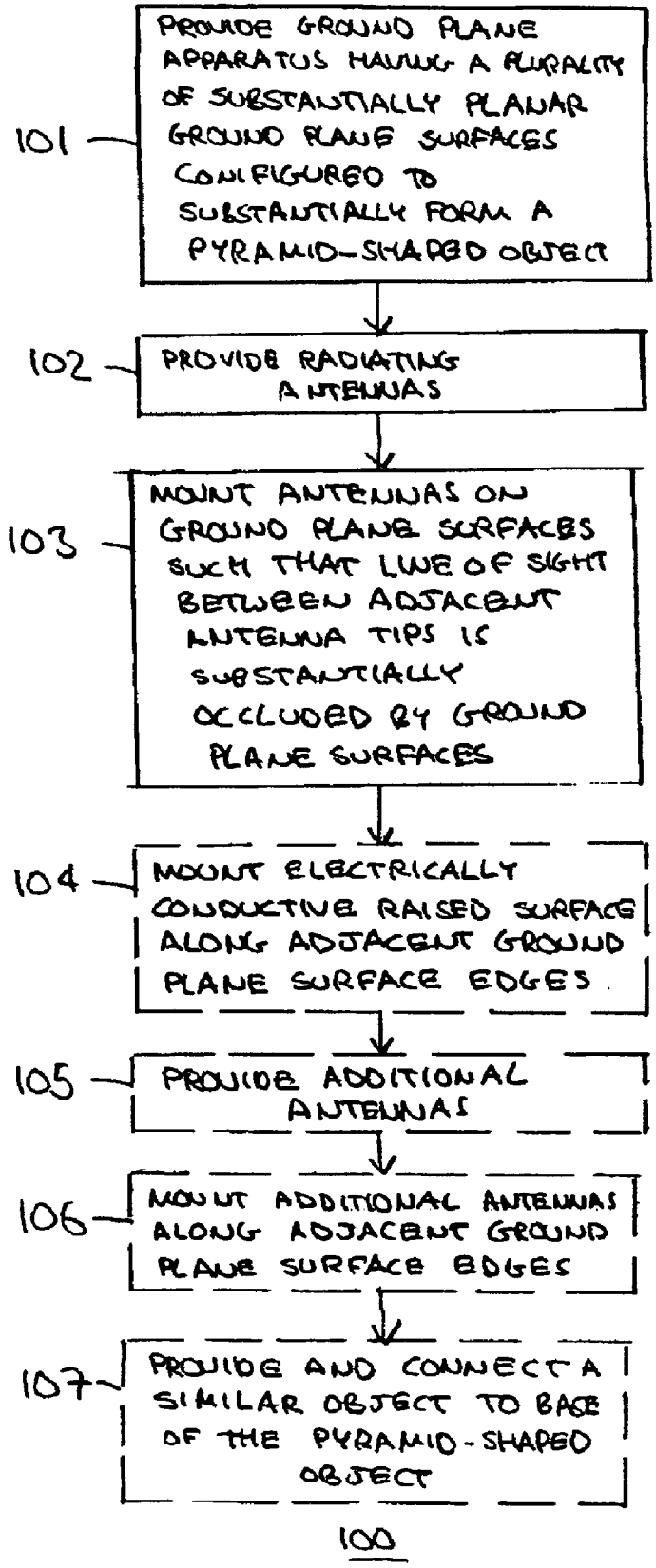
FIG. 1 comprises a flow diagram as configured in accordance with various embodiments of the invention.

Before describing in detail embodiments that are in accordance with the present invention, it should be observed that the embodiments reside primarily in combinations of method steps and apparatus components related to a method and apparatus for an antenna array. Accordingly, the apparatus components and method steps have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein. Thus, it will be appreciated that for simplicity and clarity of illustration, common and well-understood elements that are useful or necessary in a commercially feasible embodiment may not be depicted in order to facilitate a less obstructed view of these various embodiments.

In this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

Generally speaking, pursuant to these various embodiments, provided is a ground plane apparatus having a plurality of substantially planar ground plane surfaces that are connected, arranged, and configured to substantially form a pyramid-shaped object. A plurality of radiating antennas are then provided with at least one such antenna being mounted on each of the plurality of substantially planar ground plane surfaces such that a line of sight between tips of adjacent radiating antennas is substantially occluded by at least one of the substantially planar ground plan surfaces.

Pursuant to one approach, an electrically conductive raised surface is mounted along adjacent edges of the substantially planar ground plane surfaces. These raised surfaces serve, when so placed, to further aid in more fully occluding the line of sight between adjacent radiating antennas. As another optional approach, additional antennas (comprising, for example, shorted antennas) are also mounted along at least some of the above-noted adjacent edges to further aid in occluding this line of sight. (Those skilled in the art will understand that, as used herein, the expression "line of sight" refers to a primary path of radio frequency propagation.)

So configured, a number of radiating antennas are readily provided in a relatively compact space, in a relatively compact manner, and in a manner that greatly avoids or at least mitigates mutual interference. This, in turn, permits each control station radio to be coupled to its own discrete antenna, thereby avoiding the cost and insertion losses typically associated with use of a combiner. The compact design of this approach, however, also avoids the space requirements that typically encumber this one-to-one approach to antenna availability.

The pyramid shape of this structure also readily permits mounting two such structures in a base-to-base configuration. This, in turn, can double the number of available antennas with only a minimal increase in vertical space requirements and usually without increasing the need for horizontal space availability.

These and other benefits may become clearer upon making a thorough review and study of the following detailed description. Referring now to the drawings, and in particular to FIG. 1, an illustrative corresponding process 100 will be presented.

Figure 2:
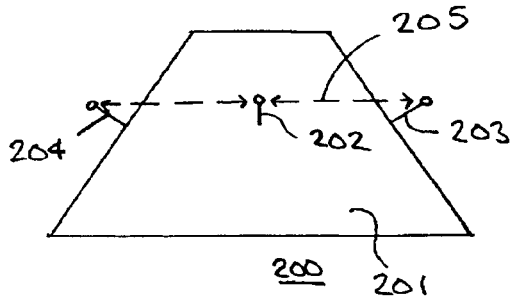
FIG. 2 comprises a side elevational view as configured in accordance with various embodiments of the invention.
Figure 3:
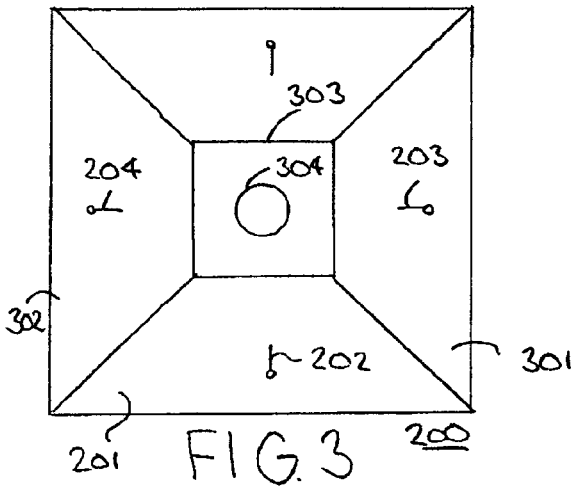
FIG. 3 comprises a top plan view as configured in accordance with various embodiments of the invention.

Pursuant to this process 100, provided 101 is a ground plane apparatus having a plurality of substantially planar ground plane surfaces that are connected, arranged, and configured to substantially form a pyramid-shaped object. For example, and referring momentarily to FIGS. 2 and 3, this object 200 may have four sides wherein each side (such as the side denoted by reference numeral 201) comprises a substantially triangle-shaped surface and, more preferably, a truncated substantially triangle-shaped surface as suggested by the illustration. As these surfaces comprise ground planes it is further preferred that these surfaces are comprised of electrically conductive material (such as a conductive metal) and/or a material (such as plastic) that is coated or laminated with an electrically conductive material.

The precise size of this object 200 will vary with the specifics of a given application setting. For an 800 MHz application a base measurement of 25 inches and a horizontal cap measurement of eight inches have been found satisfactory with a vertical height of 12 inches being useful as well.

As illustrated and described the object 200 has four essentially similar sides that together form the referred-to pyramid shape. A different number of sides might be useful and/or suitable for at least some application settings. Having four sides, however, permits antennas as are described further herein to be oriented at 90 degrees to one another. Such an orientation provides benefits that may be lessened when selecting a different number of sides. When selecting a different number of sides, it may be helpful to select an even number of sides in order to maintain bilateral symmetry.

The base of the object 200 can be solid or left open as desired. In one embodiment a cap 303 of the object 200 comprises a solid surface having a hole 304 disposed there through to facilitate mounting the object 200 on, for example, a mast. A hole 304 having, for example, a two-inch diameter is suitable for this purpose.

Referring again to FIG. 1, the process 100 also provides for the provision 102 of a plurality of radiating antennas (such as, for example, a plurality of ¼ wave unity gain 800MHz mobile spike antennas as are known in the art). These antennas are then mounted 103 on each of the substantially planar ground plane surfaces such that a line of sight between tips of adjacent radiating antennas is substantially occluded by at least one of the substantially planar ground plane surfaces. For example, and referring again to FIGS. 2 and 3, each side of the pyramid- shaped object 200 will preferably have a generally centrally located antenna affixed thereto and extending outwardly therefrom at approximately a 90degree angle. To illustrate, the exposed surface 201 in FIG. 2 has such an antenna 202 so located as does the adjacent surface 301 to the right and the adjacent surface 302 to the left. So positioned, and referring specifically to FIG. 2, the line of sight 205 between a first one of the antennas 202 and a next adjacent antenna 203 is largely or, preferably, wholly occluded by the two corresponding ground planes 201 and 301.

The angle of each ground plane surface in relation to other surfaces can be important with respect to achieving particular antenna isolation specifications. Vertically these surfaces (and hence their corresponding antenna elements) are phased at substantially 90 degrees to each other which tends to yield optimal isolation. Horizontally each adjacent antenna element is one embodiment phased at an angle of 76 degrees to each other (with opposing antenna elements being phased at 90 degrees to one another).

Figure 4:
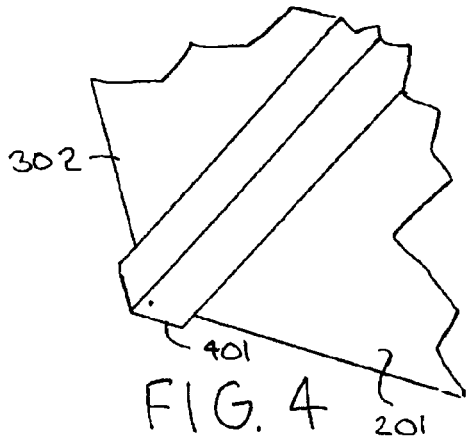
FIG. 4 comprises a detail perspective view as configured in accordance with various embodiments of the invention.

In some cases such adjacent ground planes may not extend outwardly to a sufficient distance to ensure that the ground planes alone will be sufficient to adequately occlude the line of sight between adjacent antennas. In such a case this process 100 optionally provides for mounting 104 an electrically conductive raised surface along adjacent edges of the substantially planar ground plane surface. To illustrate, and referring now to FIG. 4, the raised surface 401 can comprise an appropriately shaped member that fits atop the edge where two adjacent ground plane surfaces 201 and 302 meet. This has the effect of placing additional occluding material between adjacent antennas by outwardly extending such edges.

The shape of this raised surface 401 can vary and can assume the shape, for example, of a lip disposed along the indicated edge. The depth of this raised surface will of course vary with the specifics of a particular application. Using the exemplary dimensions suggested above for the ground plane elements themselves, however, a depth of about one inch has been found to be effective for the described purposes.

Figure 5:
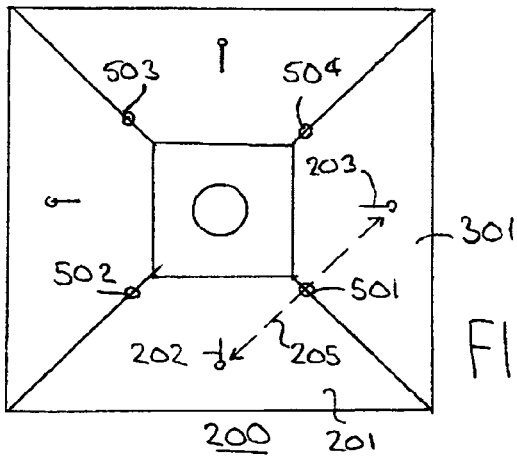
FIG. 5 comprises a top plan view as configured in accordance with various embodiments of the invention.

In some cases the addition of such a raised edge may also be insufficient to provide a desired level of isolation. In such a case, and referring now again to FIG. 1, this process 100 will accommodate the optional provision 105 of an additional plurality of antennas and the mounting 106 of such antennas along at least some of the adjacent edges of the substantially planar ground plane surfaces. To illustrate, and referring now to FIG. 5, one such additional antenna 501, 502, 503, and 504 can be placed along each such edge. In a preferred approach these antennas are placed and mounted such that this antenna substantially intersects an imaginary straight line (such as the line denoted by reference numeral 205) that separates two adjacent ones 202 and 203 of the plurality of radiating antennas. That is to say, these "shorted" antennas are preferably placed at vector intersections as characterize adjacent antenna tips. Such a configuration will tend to improve adjacent antenna isolation but may, at least under some circumstances, also decrease opposing antenna isolation.

In one embodiment these additional antennas are not intended to radiate a signal. Instead, these additional antennas are electrically shorted to the ground plane itself, either directly or via, for example, the aforementioned electrically conductive raised surfaces with which these additional antennas may be used. So configured, these shorted additional antennas can provide a significant amount of supplemental isolation between the aforementioned adjacent radiating antennas.

Figure 6:
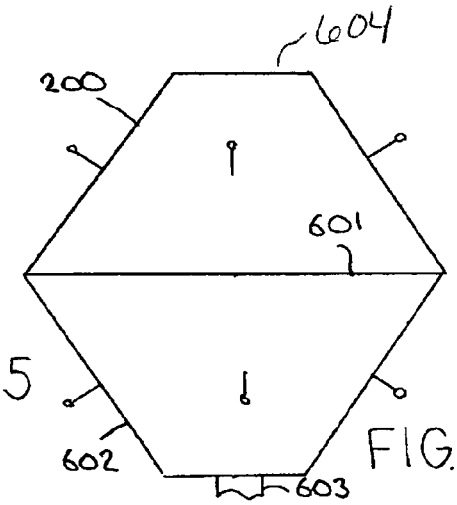
FIG. 6 comprises a side elevational view as configured in accordance with various embodiments of the invention.

Those skilled in the art will recognize and appreciate that such an antenna array as is described above will readily discretely support four corresponding control stations. It will also be understood and appreciated that two such structures can be joined to one another as shown in FIG. 6 such that the base of each structure abuts the other. More particularly, a first such object 200 having a base 601 and a narrow opposing end 604, wherein object 200 can be joined at its base 601 to the base of a second, inverted similar second object 602 as is generally provided for in step 107 of process 100 (FIG. 1). Step 107 may, accordingly, further comprise the steps of:

providing a second ground plane apparatus 602 having a plurality of substantially planar ground plane surfaces that are connected, arranged, and configured to substantially form a pyramid-shaped object; connecting a base of the second ground plane apparatus to a base of the ground plane apparatus; providing a second plurality of radiating antennas; and mounting at least one of the second plurality of radiating antennas on each of the plurality of substantially planar ground plane surfaces as comprise the second ground plane apparatus such that a line of sight between tips of adjacent radiating antennas on either of the first ground plane apparatus and the second ground plane apparatus is substantially occluded by at least one of the substantially planar ground plane surfaces as comprise either of the first ground plane apparatus and the second ground plane apparatus.

So configured, such an embodiment as illustrated in FIG. 6 would provide eight discrete radiating antennas that are operatively isolated from one another as described. If desired, raised surfaces as described above can also be placed on the edges where the bases of each structure meet in order to increase such isolation. It would also be possible, of course, to place shorted antennas as described above on the edge of the base to further increase the effective occlusion between radiating antennas on the upper structure 200 and the radiating antennas on the lower structure 602.

Such a configuration consumes relatively little space and readily permits easy mounting using, for example, a mast 603. These teachings are readily implemented in a cost-effective manner and support the use of a dedicated antenna for each of a plurality of control stations. Those skilled in the art will therefore recognize and appreciate that these teachings effectively reap the advantages of many prior art approaches while also avoiding many problems that are ordinarily associated with such approaches. It will also be understood that the roughly spherical (and substantially closed) shape of the resultant combined structure will tend to lend itself to survival in high wind operating environments.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

What is claimed is:

1. An antenna array comprising:

a plurality of substantially planar ground plane surfaces that are oriented at non-planar angles with respect to one another, wherein each of the ground plane surfaces has at least two opposing sides, and wherein the two opposing sides for each of the ground plane surfaces each contact a different other one of the ground plane surfaces; and a plurality of antennas, wherein at least one of the plurality of antennas is mounted on each of the plurality of ground plane surfaces such that the plurality of antennas are operatively isolated from each other.

2. The antenna array of claim 1, wherein the plurality of substantially planar ground plane surfaces comprises four substantially planar ground plane surfaces.

3. The antenna array of claim 1, wherein each of the plurality of substantially planar ground plane surfaces comprises a substantially triangle-shaped surface.

4. The antenna array of claim 3, wherein the substantially triangle-shaped surfaces comprise truncated substantially triangle-shaped surfaces.

5. The antenna array of claim 1 further comprising:

a plurality of raised surfaces, wherein each of the raised surfaces is disposed along a junction between adjacent ground plane surfaces.

6. The antenna array of claim 5, wherein the plurality of raised surfaces are comprised of electrically conductive material and are further electrically coupled to the ground plane surfaces.

7. The antenna array of claim 1 further comprising:

a second plurality of antennas, wherein each of the second plurality of antennas is disposed at a junction between adjacent ground plane surfaces and wherein the second plurality of antennas are electrically shorted to the ground plane surfaces.

8. An antenna array apparatus comprising:

a ground plane apparatus having a plurality of substantially planar ground plane surfaces that are connected, arranged, and configured to substantially form a pyramid-shaped object; and a plurality of radiating antennas, wherein at least one of the plurality of radiating antennas is mounted on each of the plurality of substantially planar ground plane surfaces such that a line of sight between tips of adjacent radiating antennas is occluded by at least one of:

one of the substantially planar ground plane surfaces;

a raised surface that is disposed along a junction between at least two adjacent ones of the substantially planar ground plane surfaces.

9. The antenna array apparatus of claim 8, wherein the plurality of substantially planar ground plane surfaces comprises four substantially planar ground plane surfaces of substantially equal size.

10. The antenna array apparatus of claim 8 further comprising:

a plurality of raised surfaces, wherein each of the raised surfaces is disposed along a junction between adjacent substantially planar ground plane surfaces.

11. The antenna array apparatus of claim 10, wherein the plurality of raised surfaces are comprised of electrically conductive material and are further electrically coupled to the substantially planar ground plane surfaces.

12. The antenna array apparatus of claim 11 further comprising:

a second plurality of antennas, wherein each of the second plurality of antennas is disposed on selected ones of the plurality of raised surfaces at junctions between adjacent substantially planar ground plane surfaces and wherein the second plurality of antennas are electrically shorted to the substantially planar ground plane surfaces.

13. The antenna array apparatus of claim 12, wherein at least one of the second plurality of antennas is disposed to intersect an imaginary straight line that separates two adjacent ones of the plurality of radiating antennas.

14. The antenna array apparatus of claim 8, wherein the ground plane apparatus has a base and a narrow opposing end, and wherein the antenna array apparatus further comprises:

a second ground plane apparatus having a second plurality of substantially planar ground plane surfaces that are connected, arranged, and configured to substantially form a second pyramid-shaped object, wherein the second ground plane apparatus has a base and a narrow opposing end and wherein the base of the second ground plane apparatus and the base of the ground plane apparatus are disposed against one another; and a second plurality of radiating antennas, wherein at least one of the second plurality of radiating antennas is mounted on each of the second plurality of substantially planar ground plane surfaces such that a line of sight as between tips of adjacent radiating antennas is occluded by at least one of:

one of the substantially planar ground plane surfaces;

a raised surface that is disposed along a junction between at least two adjacent ones of the substantially planar ground plane surfaces.

15. A method comprising the steps of:

providing a ground plane apparatus having a plurality of substantially planar ground plane surfaces that are connected, arranged, and configured to substantially form a pyramid-shaped object;

providing a plurality of radiating antennas; and mounting at least one of the plurality of radiating antennas on each of the plurality of substantially planar ground plane surfaces such that a line of sight between tips of adjacent radiating antennas is substantially occluded by at least one of the substantially planar ground plane surfaces.

16. The method of claim 15 further comprising the step of:

mounting an electrically conductive raised surface along adjacent edges of the substantially planar ground plane surfaces.

17. The method of claim 16 further comprising the steps of:

providing a second plurality of antennas; and mounting each of the second plurality of antennas along one of the adjacent edges of the substantially planar ground plane surfaces.

18. The method of claim 17, wherein mounting each of the second plurality of antennas along one of the adjacent edges of the substantially planar ground plane surfaces further comprises mounting the second plurality of antennas such that at least one of the second plurality of antennas is disposed to intersect an imaginary straight line that separates two adjacent ones of the plurality of radiating antennas.

19. The method of claim 15 farther comprising the steps of:

providing a second ground plane apparatus having a plurality of substantially planar ground plane surfaces that are connected, arranged, and configured to substantially form a pyramid-shaped object;

connecting a base of the second ground plane apparatus to a base of the ground plane apparatus;

providing a second plurality of radiating antennas; and mounting at least one of the second plurality of radiating antennas on each of the plurality of substantially planar ground plane surfaces as comprise the second ground plane apparatus such that a line of sight between tips of adjacent radiating antennas on either of the ground plane apparatus and the second ground plane apparatus is substantially occluded by at least one of:

one of the substantially planar ground plane surfaces as comprise either of the ground plane apparatus and the second ground plane apparatus; and a raised surface that is disposed along a junction between at least two adjacent ones of the substantially planar ground plane surfaces.

* * * * *